US008702301B2

(12) United States Patent
Hiraoka et al.

(10) Patent No.: US 8,702,301 B2
(45) Date of Patent: Apr. 22, 2014

(54) TIMEPIECE BEARING, MOVEMENT, AND PORTABLE TIMEPIECE

(75) Inventors: Masashi Hiraoka, Chiba (JP); Masahiro Nakajima, Chiba (JP); Takashi Niwa, Chiba (JP)

(73) Assignee: Seiko Instruments Inc. (JP)

( * ) Notice: Subject to any disclaimer, the term of this patent is extended or adjusted under 35 U.S.C. 154(b) by 619 days.

(21) Appl. No.: 12/924,550

(22) Filed: Sep. 29, 2010

(65) Prior Publication Data

US 2011/0080810 A1 Apr. 7, 2011

(30) Foreign Application Priority Data

Oct. 7, 2009 (JP) ..... 2009-233805

(51) Int. Cl.
*G04B 31/00* (2006.01)

(52) U.S. Cl.
CPC ..... *G06B 31/02* (2013.01)
USPC ..... 368/324; 368/326; 384/125

(58) Field of Classification Search
USPC ..... 368/324–326; 384/125, 215
See application file for complete search history.

(56) References Cited

U.S. PATENT DOCUMENTS

| | | | | |
|---|---|---|---|---|
| 1,128,068 | A * | 2/1915 | Sokolowski | 368/326 |
| 2,233,743 | A * | 3/1941 | Marti | 368/324 |
| 2,849,855 | A * | 9/1958 | Seitz | 368/324 |
| 2,973,618 | A * | 3/1961 | Morf | 368/326 |
| 3,146,582 | A * | 9/1964 | Loretan | 368/326 |
| 3,237,394 | A * | 3/1966 | Gunther Scholz et al. | 368/326 |
| 3,306,027 | A * | 2/1967 | Schneider | 368/326 |
| 3,306,028 | A * | 2/1967 | Suzuki | 368/326 |
| 3,487,632 | A * | 1/1970 | Gunther | 368/326 |
| 3,712,051 | A * | 1/1973 | Romang et al. | 368/326 |
| 3,942,848 | A * | 3/1976 | Voumard | 384/125 |
| 7,344,303 | B2 * | 3/2008 | Conus et al. | 368/324 |
| 2006/0215499 | A1 * | 9/2006 | Kohler et al. | 368/324 |
| 2007/0291593 | A1 * | 12/2007 | Tokoro et al. | 368/221 |

FOREIGN PATENT DOCUMENTS

JP 2004294320 10/2004

* cited by examiner

*Primary Examiner* — Vit W Miska
(74) *Attorney, Agent, or Firm* — Adams & Wilks

(57) ABSTRACT

A timepiece bearing has a bearing member of unitary construction that is provided at least at one end portion of a shaft member for undergoing rotation around an axis and that regulates movement of the shaft member in axial and radial directions of the shaft member. An elastic member applies an urging force in an axial direction of the bearing member to hold the bearing member in contact with the shaft member. A frame member supported by and fixed to a support member contains the bearing member. The elastic member is provided so as to establish connection between the bearing member and the frame member. The shaft member is configured to undergo rotation around the rotational axis while the shaft member and the bearing member are held in contact with each other by the elastic member.

25 Claims, 12 Drawing Sheets

TIMEPIECE BEARING, MOVEMENT, AND PORTABLE TIMEPIECE

BACKGROUND OF THE INVENTION

1. Field of the Invention

The present invention relates to a timepiece bearing, a movement, and a portable timepiece.

2. Description of the Related Art

Conventionally, a rotating mechanical component such as a gear used in a portable timepiece, such as a wristwatch or a pocket watch, is formed such that a bearing is arranged so as to contain rotation shaft ends thereof and that the rotation shaft is rotated while guided by the bearing to transmit torque, thereby ticking away the time.

Here, as the construction of a conventional timepiece bearing, a construction as shown in FIG. 21 is known (See, for example, JP-A-2004-294320). FIG. 21 is a sectional view of a balance with hairspring.

As shown in FIG. 21, a balance with hairspring 520 includes a balance staff 523 whose thin small-diameter portions 521 and 522 at both ends thereof are supported so as to be rotatable around a center axis C by a timepiece bearing 510 formed in a balance bridge 505 and a main plate 504 so as to extend along the center axis C, a balance wheel 528 equipped with an annular rim portion 524 constituting a balance wheel main body and an arm portion 525 whose both ends are connected to the rim portion 524 and which extends in the diametrical direction of the rim portion 524, with an intermediate portion 526 of the arm portion 525 being fixed to a central shaft portion 527 of the balance staff 523, a collet 550, and a double roller 554 retaining an impulse pin 552.

The timepiece bearing 510 has an outer side bearing frame 512 retained by the inner peripheral surface of the balance bridge 505, an inner bearing frame 511 arranged inside the outer bearing frame 512, a hole jewel 514 arranged in a medium diameter recess of the inner bearing frame 511 and serving as a journal bearing for the small diameter shaft portion 522 at the upper end of the balance staff 523, a cap jewel 515 arranged in a large diameter recess of the inner side bearing frame 515 and serving as a thrust bearing for the small diameter shaft portion 522 of the balance staff 523, and a presser spring 516 locked to a groove of the outer side bearing frame 512 and retaining the cap jewel 515 in the large diameter recess of the inner side bearing frame 511.

To permit rotation of the shaft, the above-described conventional timepiece bearing 510 requires a gap or space between the shaft (the small diameter shaft portion 522) and the bearing (the cap jewel 515). Due to the presence of this space, when the attitude of the timepiece is changed or an impact is applied thereto, the position of the shaft fluctuates. Then, the torque transmitted from a barrel drum to the balance with hairspring fluctuates, resulting in fluctuation in the oscillation angle and the rate. As a result, the time indication accuracy of the timepiece deteriorates.

The present invention has been made in view of the above problem. It is an object of the present invention to provide a timepiece bearing, a movement, and a portable timepiece helping to achieve an improvement in terms of time indication accuracy.

SUMMARY OF THE INVENTION

To solve the above problem, the present invention provides the following techniques.

According to the present invention, there is provided a timepiece bearing comprising: a bearing member provided at at least one end portion of a shaft member rotating around an axis and regulating movement of the shaft member in axial and radial directions; an elastic member having an force facing in axial direction to the bearing member; and a frame member containing the bearing member, wherein the elastic member is provided so as to establish connection between the bearing member and the frame member; the frame member is supported by and fixed to a support member; and the shaft member is rotatable around the axis, with the shaft member and the bearing member being held in contact with each other by the elastic member.

Due to this construction, it is possible to rotate the shaft member around the axis, with no space formed between the shaft member and the bearing member. Thus, even if the attitude of the timepiece bearing is changed or an impact is applied thereto, it is possible to suppress fluctuation in the position of the shaft member. As a result, it is possible to suppress fluctuation in torque, so that it is possible to achieve an improvement in terms of the time indication accuracy of the timepiece.

Further, the elastic member is equipped with an inner ring portion inserted to surroundings of and fixed to the bearing member, and a plurality of spring portions extending radially outwards from the inner ring portion, and the forward ends of the spring portions can be supported by the frame member.

Due to this construction, it is possible to support and fix the elastic member in a position between the bearing member and the frame member, making it possible to impart an urging force between the bearing member and the frame member due to the spring portions. Further, the frame member is supported by and fixed to the support member, so that the bearing member strives to move in an urging direction with respect to the frame member. Thus, by urging the spring portions toward the shaft member, it is possible to urge the bearing member reliably in the direction of the shaft member, making it possible to bring the bearing member and the shaft member into contact with each other. As a result, it is possible to suppress fluctuation in the position of the shaft member, and to suppress fluctuation in torque, so that it is possible to improve the time indication accuracy of the timepiece.

Further, the above-mentioned elastic member is equipped with an outer ring portion inserted to inner in and fixed to the frame member, and a plurality of spring portions extending radially inwards from the outer ring portion, and the forward ends of the spring portions can be supported by the bearing member.

Due to this construction, it is possible to support and fix the elastic member in position between the bearing member and the frame member, and it is possible to impart an urging force between the bearing member and the frame member due to the spring portions. Further, since the frame member is supported by and fixed to the support member, the bearing member strives to move in the urging direction with respect to the frame member. Thus, by urging the spring portions toward the shaft member, it is possible to reliably urge the bearing member in the direction of the shaft member, making it possible to bring the bearing member and the shaft member into contact with each other. As a result, it is possible to suppress fluctuation in the position of the shaft member, and to suppress fluctuation in torque, so that it is possible to achieve an improvement in the time indication accuracy of the timepiece.

Further, there is provided a pressurization adjustment mechanism capable of adjusting the pressure applied by a force from the bearing member toward the shaft member.

Due to this construction, it is easily possible to effect setting to a pressure allowing the shaft member to rotate around the axis while holding the bearing member and the shaft member in contact with each other.

Further, the pressurization adjustment mechanism is formed by a screw portion formed between the outer peripheral surface of the frame member and the inner peripheral surface of the support member.

Due to this construction, the threaded engagement ratio of the frame member with respect to the support member is adjusted, whereby it is possible to easily adjust the pressure with which urging is effected from the bearing member toward the shaft member.

Further, the pressurization adjustment mechanism is formed by a plurality of spring support recesses formed in the inner peripheral surface of the frame member at axially deviated positions.

Due to this construction, by selecting the positions for supporting the spring portions of the elastic member from the plurality of spring support recesses formed at axially deviated positions, it is possible to easily adjust the pressure with which urging is effected from the bearing member toward the shaft member.

Further, the pressurization adjustment mechanism consists of a spirally formed spring support groove portion formed in the inner peripheral surface of the frame member.

Due to this construction, by moving the forward ends of the spring portions of the elastic member along the spring support groove portion, it is possible to easily adjust the pressure with which urging is effected from the bearing member toward the shaft member.

Further, there is provided an attachment/detachment mechanism allowing attachment and detachment of the elastic member to and from the frame member.

Due to this construction, when performing maintenance on the timepiece bearing, it is possible to easily remove the elastic member from the frame member, making it possible to perform maintenance on each member. Thus, it is possible to achieve an improvement in terms of maintenance efficiency.

Further, the attachment/detachment mechanism is equipped with fit-engagement protrusions formed at the forward ends of the spring portions of the elastic member, and a fit-engagement recess formed in one axial end surface of the frame member, and, after the fit-engagement protrusions of the elastic member have passed the fit-engagement recess of the frame member, the elastic member is rotated along the engagement groove portion formed in the peripheral direction in the inner peripheral surface of the frame member, whereby the elastic member is supported by the frame member.

Due to this construction, by rotating the elastic member along the engagement groove portion of the frame member and mating the fit-engagement protrusion and the fit-engagement recess with each other to draw it out, it is possible to easily attach and detach the elastic member to and from the frame member. Thus, it is possible to achieve an improvement in terms of maintenance efficiency.

Further, there is provided an attachment/detachment mechanism allowing attachment and detachment of the elastic member to and from the bearing member.

Due to this construction, when performing maintenance on the timepiece bearing, it is possible to easily remove the elastic member from the bearing member, making it possible to perform maintenance on each member. Thus, it is possible to achieve an improvement in terms of maintenance efficiency.

Further, the attachment/detachment mechanism is equipped with fit-engagement protrusions formed at the forward ends of the spring portions of the elastic member, and a fit-engagement recess formed in one axial end surface of the bearing member, and, after the fit-engagement protrusions of the elastic member have passed the fit-engagement recess of the bearing member, the elastic member is rotated along the engagement groove portion formed in the peripheral direction in the outer peripheral surface of the bearing member, whereby the elastic member is supported by the bearing member.

Due to this construction, by rotating the elastic member along the engagement groove portion of the bearing member and mating the fit-engagement protrusion and the fit-engagement recess with each other to draw it out, it is possible to easily attach and detach the elastic member to and from the bearing member. Thus, it is possible to achieve an improvement in terms of maintenance efficiency.

Further, on the opposite side of the shaft member through the intermediation of the bearing member, there is provided a stopper member regulating the axial displacement amount of the bearing member.

Due to this construction, even if the attitude of the timepiece is changed or an impact is applied thereto, it is possible to suppress axial displacement of the bearing member. As a result, it is possible to suppress fluctuation in the position of the shaft member and to suppress fluctuation in torque, so that it is possible to achieve an improvement in terms of the time indication accuracy of the timepiece.

Further, the stopper member is fixed to the frame member, and is arranged with an axial gap between itself and the bearing member.

Due to this construction, it is possible to arrange the stopper member without affecting the pressure with which urging is effected from the bearing member toward the shaft member. Thus, it is possible to achieve an improvement in terms of the time indication accuracy of the timepiece.

Further, there is provided a guide member restricting the movable direction of the bearing member to the axial direction.

Due to this construction, it is possible to reliably prevent displacement of the shaft member in a radial direction that is orthogonal to the axial direction. Thus, it is possible to achieve an improvement in terms of the time indication accuracy of the timepiece.

Further, the guide member is fixed to the inner peripheral surface of the frame member.

Due to this construction, solely by fixing the guide member to the inner peripheral surface of the frame member, it is possible to reliably prevent the shaft member from being displaced in the radial direction that is orthogonal to the axial direction. Thus, it is possible to achieve an improvement in terms of the time indication accuracy of the timepiece with a simple construction.

Further, the bearing member and the elastic member are formed integrally.

Due to this construction, it is possible to reduce the number of components, and to achieve an improvement in terms of the production efficiency at the time of production and the maintenance efficiency at the time of maintenance.

Further, the elastic member and the frame member are formed integrally.

Due to this construction, it is possible to reduce the number of components, and to achieve an improvement in terms of the production efficiency at the time of production and the maintenance efficiency at the time of maintenance.

Further, the frame member and the stopper member are formed integrally.

Due to this construction, it is possible to reduce the number of components, and to achieve an improvement in terms of the production efficiency at the time of production and the maintenance efficiency at the time of maintenance.

Further, the bearing member and the stopper member are formed integrally.

Due to this construction, it is possible to reduce the number of components, and to achieve an improvement in terms of the production efficiency at the time of production and the maintenance efficiency at the time of maintenance.

Further, the bearing member and the guide member are formed integrally.

Due to this construction, it is possible to reduce the number of components, and to achieve an improvement in terms of the production efficiency at the time of production and the maintenance efficiency at the time of maintenance.

Further, the frame member and the guide member are formed integrally.

Due to this construction, it is possible to reduce the number of components, and to achieve an improvement in terms of the production efficiency at the time of production and the maintenance efficiency at the time of maintenance.

Further, a movement according to the present invention is a timepiece movement equipped with a barrel drum, wheels & pinions, an escape wheel & pinion, a pallet fork, and a balance with hairspring, and, a timepiece bearing as described above is used at least as the bearing of the balance with hairspring.

Due to this construction, it is possible to rotate the shaft member around the axis with no space formed between the shaft member and the bearing member, so that, even if the attitude of the timepiece bearing is changed or an impact is applied thereto, it is possible to suppress fluctuation in the position of the shaft member. As a result, it is possible to suppress fluctuation in torque, so that it is possible to provide a movement helping to achieve an improvement in term of the time indication accuracy of the timepiece.

A portable timepiece according to the present invention is equipped with the above-described movement, and a casing containing the movement.

Due to this construction, it is possible to rotate the shaft member around the axis with no space formed between the shaft member and the bearing member, so that, even if the attitude of the timepiece bearing is changed or an impact is applied thereto, it is possible to suppress fluctuation in the position of the shaft member. As a result, it is possible to suppress fluctuation in torque, so that it is possible to provide a portable timepiece helping to achieve an improvement in term of the time indication accuracy of the timepiece.

In the timepiece bearing of the present invention, it is possible to rotate the shaft member around the axis with no space formed between the shaft member and the bearing member, so that, even if the attitude of the timepiece bearing is changed or an impact is applied thereto, it is possible to suppress fluctuation in the position of the shaft member. As a result, it is possible to suppress fluctuation in torque, so that it is possible to achieve an improvement in term of the time indication accuracy of the timepiece.

DETAILED DESCRIPTION OF THE PREFERRED EMBODIMENTS

Next, a timepiece bearing according to an embodiment of the present invention will be described with reference to FIGS. 1 through 20. In this embodiment, described below, the timepiece bearing is applied to a portable mechanical timepiece such as a wristwatch.

(Mechanical Timepiece)

Figure 1:
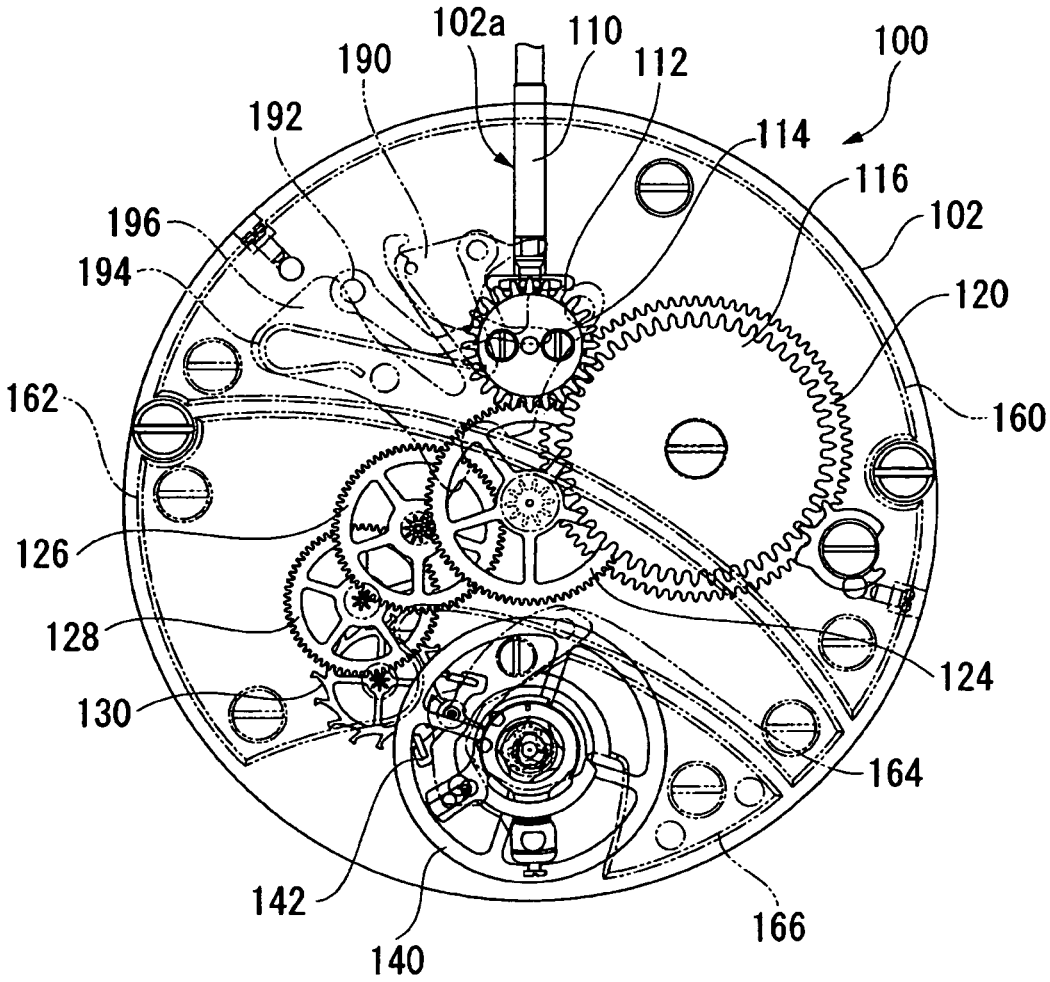
FIG. 1 is a plan view of the front side of a movement of a mechanical timepiece according to an embodiment of the present invention (A part of the components are omitted, and a bridge member is indicated by a phantom line)
Figure 2:
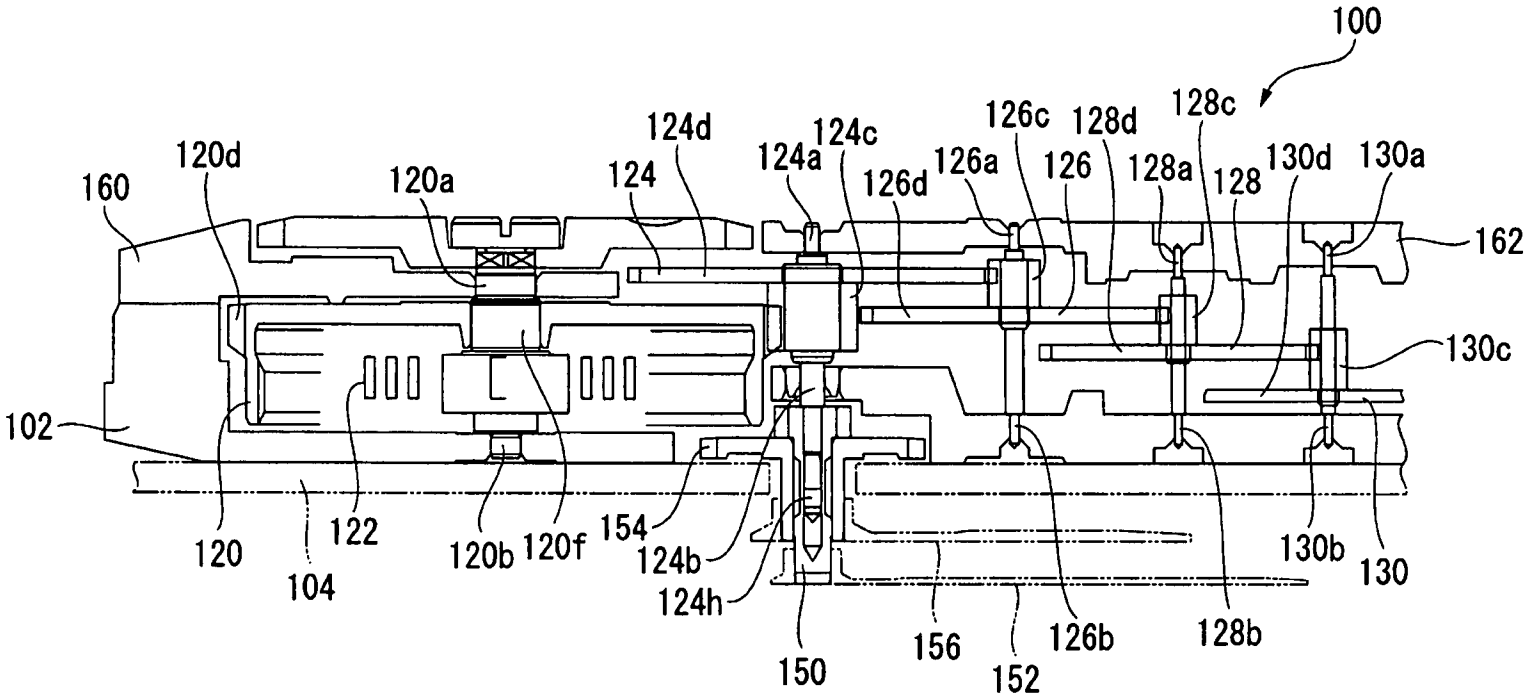
FIG. 2 is a schematic partial sectional view showing a portion extending from a barrel drum to an escape wheel & pinion according to an embodiment of the present invention.
Figure 3:
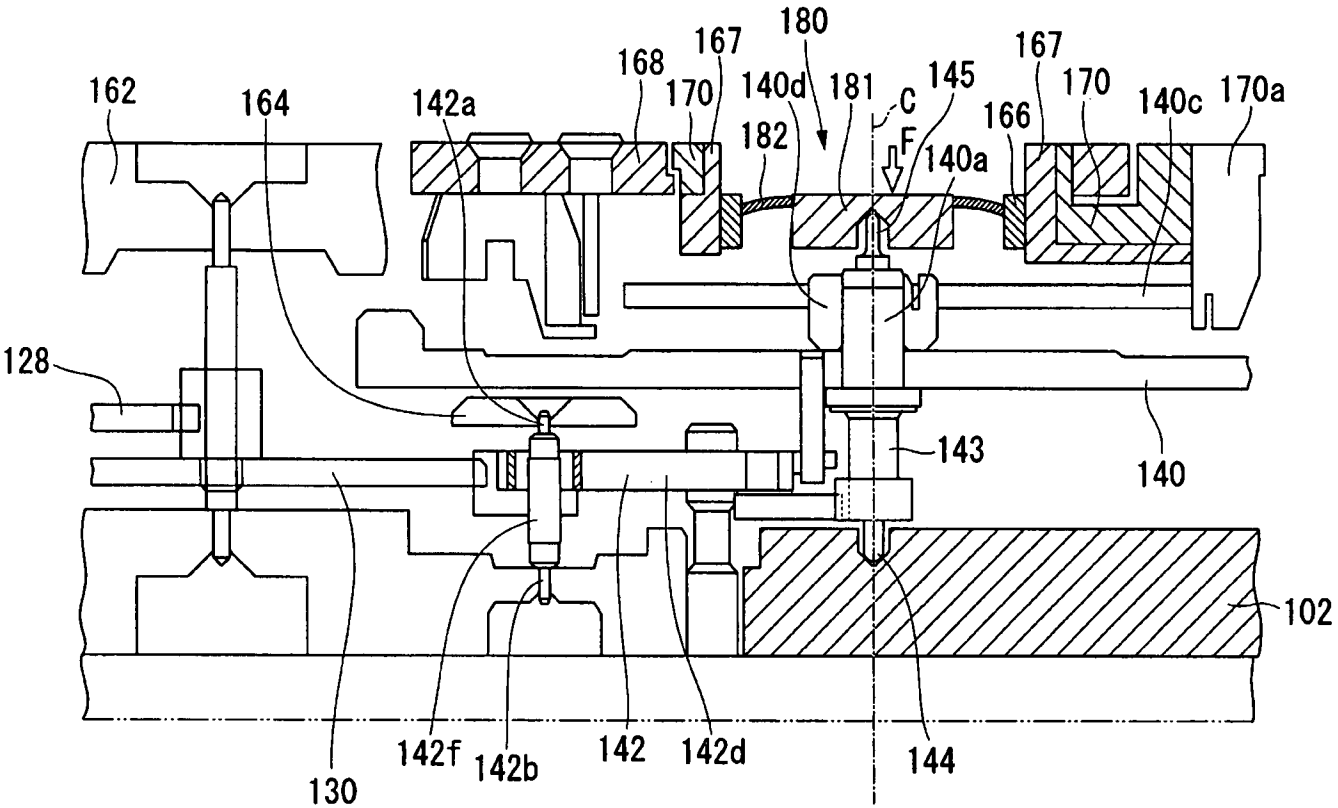
FIG. 3 is a schematic partial sectional view showing a portion from an escape wheel & pinion to a balance with hairspring according to an embodiment of the present invention.

As shown in FIGS. 1 through 3, a movement 100 of a mechanical timepiece has a main plate 102 constituting a base plate of the movement 100. A winding stem 110 is rotatably incorporated into a winding stem guide hole 102*a* of the main plate 102. A dial 104 (See FIG. 2) is mounted to the movement 100. Generally speaking, of the two sides of the main plate 102, the side where the dial 104 is arranged is referred to as the back side of the movement 100, and the side opposite to the side where the dial 104 is arranged is referred to as the front side of the movement 100. A train wheel assembled to the front side of the movement 100 is referred to as the front train wheel, and a train wheel assembled to the back side of the movement 100 is referred to as the back train wheel. By providing the movement 100 with a casing (not shown), the timepiece is formed as a portable timepiece.

The position in the axial direction of the winding stem 110 is determined by a switching device including a setting lever 190, a yoke 192, a yoke spring 194, and a setting lever jumper 196. A winding pinion 112 is rotatably provided on the guide shaft portion of the winding stem 110. When the winding stem 110 is rotated, with the winding stem 110 being at a first winding stem position ($0^{th}$ step) nearest to the inner side of the movement 100 in the direction of the rotation axis, the winding pinion 112 is rotated via rotation of a clutch wheel. A crown wheel 114 is rotated through rotation of the winding pinion 112. Through rotation of a ratchet wheel 116, a mainspring 122 (See FIG. 2) accommodated in a movement barrel 120 is wound up.

A center wheel & pinion 124 is rotated through rotation of the movement barrel 120. An escape wheel & pinion 130 is rotated through rotation of a second wheel & pinion 128, a third wheel & pinion 126, and the center wheel & pinion 124. The movement barrel 120, the center wheel & pinion 124, the third wheel & pinion 126, and the second wheel & pinion 128 constitute the front train wheel.

An escapement/governor for controlling the rotation of the front train wheel includes a balance with hairspring 140, an escape wheel & pinion 130, and a pallet fork 142. Based on the rotation of the center wheel & pinion 124, a cannon pinion 150 rotates simultaneously. A minute hand 152 mounted to the cannon pinion 150 indicates "minute." The cannon pinion 150 is provided with a slip mechanism with respect to the center wheel & pinion 124. Based on the rotation of the cannon pinion 150, an hour wheel 154 is rotated through rotation of a minute wheel. An hour hand 156 mounted to the hour wheel 154 indicates "hour."

The movement barrel 120 is equipped with a barrel cogwheel 120*d*, a barrel arbor 120*f*, and a mainspring 122. The barrel arbor 120*f* includes an upper shaft portion 120*a* and a lower shaft portion 120*b*. The barrel arbor 120*f* is formed of a metal such as carbon steel. The barrel cogwheel 120*d* is formed of a metal such as brass.

The center wheel & pinion 124 includes an upper shaft portion 124*a*, a lower shaft portion 124*b*, a pinion portion 124*c*, a cogwheel portion 124*d*, and a bead portion 124*h*. The pinion portion 124*c* of the center wheel & pinion 124 is in mesh with the barrel cogwheel 120*d*. The upper shaft portion 124*a*, the lower shaft portion 124*b*, and the bead portion 124*h* are formed of a metal such as carbon steel. The cogwheel portion 124*d* is formed of a metal such a nickel.

The third wheel & pinion 126 includes an upper shaft portion 126*a*, a lower shaft portion 126*b*, a pinion portion 126*c*, and a cogwheel portion 126*d*. The pinion portion 126*c* of the third wheel & pinion 126 is in mesh with the cogwheel portion 124*d*.

The second wheel & pinion 128 includes an upper shaft portion 128*a*, a lower shaft portion 128*b*, a pinion portion 128*c*, and a cogwheel portion 128*d*. The pinion portion 128*c* of the second wheel & pinion 128 is in mesh with the cogwheel portion 126*d*. The upper shaft portion 128*a* and the lower shaft portion 128*b* are formed of a metal such as carbon steel. The cogwheel portion 128*d* is formed of a metal such as nickel.

The escape wheel & pinion 130 includes an upper shaft portion 130*a*, a lower shaft portion 130*b*, a pinion portion 130*c*, and a cogwheel portion 130*d*. The pinion portion 130*c* of the escape wheel & pinion 130 is in mesh with the cogwheel portion 128*d*. The pallet fork 142 is equipped with a body of pallet fork 142*d*, and a pallet staff 142*f*. The pallet staff 142*f* includes an upper shaft portion 142*a* and a lower shaft portion 142*b*.

The movement barrel 120 is supported so as to be rotatable with respect to the main plate 102 and a barrel bridge 160. That is, the upper shaft portion 120*a* of the barrel arbor 120*f* is supported so as to be rotatable with respect to the barrel bridge 160. The lower shaft portion 120*b* of the barrel arbor 120*f* is supported so as to be rotatable with respect to the main plate 102. The center wheel & pinion 124, the third wheel & pinion 126, the second wheel & pinion 128, the escape wheel & pinion 130 are supported so as to be rotatable with respect to the main plate 102 and a train wheel bridge 162. That is, the upper shaft portion 124*a* of the center wheel & pinion 124, the upper shaft portion 126*a* of the third wheel & pinion 126, the upper shaft portion 128*a* of the second wheel & pinion 128, and the upper shaft portion 130*a* of the escape wheel & pinion 130 are supported so as to be rotatable with respect to the train wheel bridge 162. Further, the lower shaft portion 124*b* of the center wheel & pinion 124, the lower shaft portion 126*b* of the third wheel & pinion 126, the lower shaft portion 128*b* of the second wheel & pinion 128, and the lower shaft portion 130*b* of the escape wheel & pinion 130 are supported so as to be rotatable with respect to the main plate 102.

The pallet fork 142 is supported so as to be rotatable with respect to the main plate 102 and the pallet bridge 164. That is, an upper shaft portion 142*a* of the pallet fork 142 is supported so as to be rotatable with respect to a pallet bridge 164. A lower shaft portion 142*b* of the pallet fork 142 is supported so as to be rotatable with respect to the main plate 102.

Lubricating oil is applied to a bearing portion of the barrel bridge 160 rotatably supporting the upper shaft portion 120*a* of the barrel arbor 120*f*, to a bearing portion of the train wheel bridge 162 rotatably supporting the upper shaft portion 124*a* of the center wheel & pinion 124, to a bearing portion of the train wheel bridge 162 rotatably supporting the upper shaft portion 126*a* of the third wheel & pinion 126, to a bearing portion of the train wheel bridge 162 rotatably supporting the upper shaft portion 128*a* of the second wheel & pinion 128, to a bearing portion of the train wheel bridge 162 rotatably supporting the upper shaft portion 130*a* of the escape wheel & pinion 130, and to a bearing portion of the pallet bridge 164 rotatably supporting the upper shaft portion 142*a* of the pallet fork 142. Further, lubricating oil is applied to a bearing portion of the main plate 102 rotatably supporting the lower shaft portion 120*b* of the barrel arbor 120*f*, to a bearing portion of the main plate 102 rotatably supporting the lower shaft portion 124*b* of the center wheel & pinion 124, to a bearing portion of the main plate 102 rotatably supporting the lower shaft portion 126*b* of the third wheel & pinion 126, to a bearing portion of the main plate 102 rotatably supporting the lower shaft portion 128*b* of the second wheel & pinion 128, to a bearing portion of the main plate 102 rotatably supporting the lower shaft portion 130*b* of the escape wheel & pinion 130, and to a bearing portion of the main plate 102 rotatably supporting the lower shaft portion 142*b* of the pallet fork 142. It is desirable for this lubricating oil to be a precision instrument oil, and, in particular, a so-called timepiece oil In order to enhance the lubricating oil performance, it is desirable for each of the bearing portions of the main plate 102, the bearing portion of the barrel bridge 160, and the bearing portion of the train wheel bridge 162 to be provided with a conical, cylindrical, or truncated-cone-shaped oil sump portion. When the oil sump portion is provided, it is possible to effectively prevent diffusion of oil due to the surface tension of the lubricating oil. The main plate 102, the barrel bridge 160, the train wheel bridge 162, and the pallet bridge 164 may be formed of a metal such as brass or a resin such as polycarbonate.

(Structure of the Balance with Hairspring)

Next, the structure of the balance with hairspring of this embodiment will be described.

As shown in FIG. 3, the balance with hairspring 140 is equipped with a balance staff 140*a* and a hairspring 140*c*.

The hairspring 140*c* is a volute (spiral) thin plate bearing of a plurality of turns. The inner end portion of the hairspring 140*c* is fixed to a collet 140*d* fixed to the balance staff 140*a*, and the outer end portion of the hairspring 140*c* is fixed in position by screw fastening via a stud 170*a* mounted to a stud support 170 rotatably mounted to the balance bridge 167. A bearing 180 is fixed to the balance bridge (support member) 167 via the outer peripheral portion of a frame member 166. A regulator 168 is rotatably mounted to the balance bridge 167. Further, the balance with hairspring 140 is supported so as to be rotatable with respect to the main plate 102 and the balance bridge 167.

Here, the balance with hairspring 140 is rotatable around a center axis C, and has thin shaft portions 144 and 145 at both ends of a shaft member 143. The lower shaft portion 144 is supported so as to be rotatable with respect to the main plate 102, and the upper shaft portion 145 is supported so as to be rotatable with respect to the bearing 180.

The bearing 180 is equipped with a bearing member 181 provided on the side of the shaft portion 145 constituting one end portion of the shaft member 143 rotating around the center axis C and adapted to regulate axial and radial movement of the shaft member 143, an elastic member 182 exerting an axial urging force F with respect to the bearing member 181, and the frame member 166 containing the bearing member 181.

Figure 4:
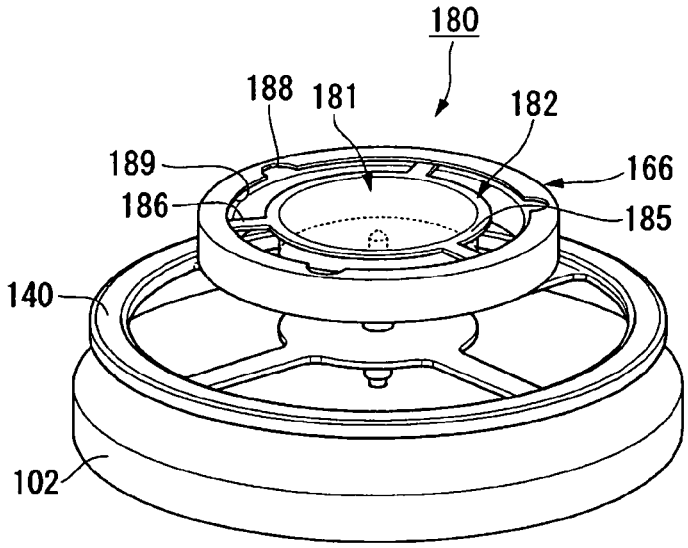
FIG. 4 is a perspective view of a balance with hairspring and a bearing according to an embodiment of the present invention.
Figure 5:
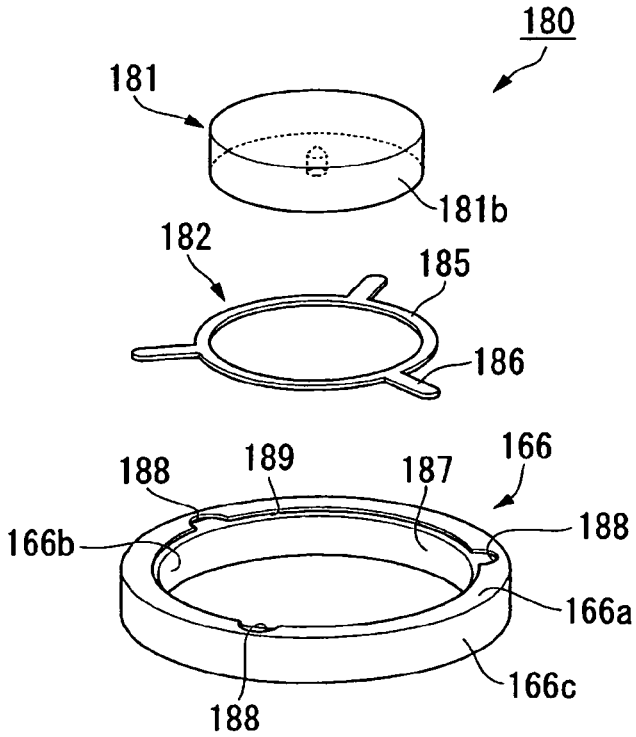
FIG. 5 is an exploded perspective view of a bearing according to an embodiment of the present invention.
Figure 6:
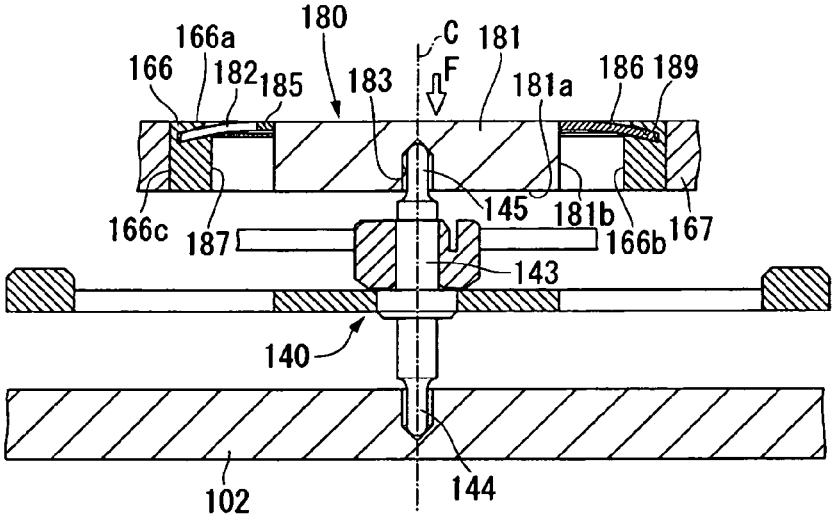
FIG. 6 is a sectional view of a balance with hairspring and a bearing according to an embodiment of the present invention.

As shown in FIGS. 4 through 6, the bearing member 181 is of unitary construction and formed in a substantially cylindrical configuration, and at a central portion on one surface 181*a* supporting the shaft portion 145, there is formed an insertion hole (blind bore) 183 into which the shaft portion 145 is inserted. Formed at the bottom portion of the insertion hole 183 is a tapered portion tapered forwards. Further, the forward end of the shaft portion 145 is formed in a substantially spherical configuration, and the forward end of the shaft portion 145 can abut the tapered portion of the insertion hole 183. That is, the forward end of the shaft portion 145 and the tapered portion of the insertion hole 183 are in line contact with each other in the peripheral direction; in this state, axial and radial movement of the shaft portion 145 is regulated.

An elastic member 182 consists of a plate spring member formed, for example, of metal. The elastic member 182 is equipped with an inner ring portion 185 formed so as to be capable of being forced into and fixed to an outer peripheral surface 181*b* of the bearing member 181, and a plurality of spring portions 186 extending radially outwards from the inner ring portion 185. In this embodiment, three spring portions 186 are formed at substantially equal peripheral intervals. As shown in FIG. 3, the elastic member 182 is arranged so as to be curved in the initial state; however, this should not be construed restrictively; it is also possible for the elastic member to be arranged so as to be flat in the initial state.

The frame member 166 is formed in a substantially cylindrical configuration, and has a through-hole 187 capable of containing the bearing member 181 and the elastic member 182. Further, one surface 166*a* of the frame member 166 has a plurality of (three in this embodiment) cutout portions 188 in conformity with the configuration of the spring portions 186 so as to allow insertion of the forward ends of the spring portions 186 of the elastic member 182. Further, the inner peripheral surface 166*b* of the frame member 166 has, over the entire periphery, a groove portion 189 with which the forward ends of the spring portions 186 are fit-engaged for support in the peripheral direction. The cutout portions 188 and the groove portions 189 are connected with each other. That is, by inserting the forward ends of the spring portions 186 in conformity with the positions of the cutout portions 188, the forward ends of the spring portions 186 can be arranged in the groove portion 189, and, in this state, the elastic member 182 is rotated in the peripheral direction with respect to the frame member 166 to support and fix the forward ends of the spring portions 186 in the groove portion 189, whereby the spring portions 186 of the elastic member 182 can be supported by and fixed to the frame member 166. Furthermore, an outer peripheral surface 166*c* of the frame member 166 is forced into an inner peripheral surface of the balance bridge 167 for fixation.

Here, the elastic member 182 has an urging force F urging the bearing member 181 in the direction of the shaft portion 145 (the shaft member 143). This urging force F brings the bearing member 181 into contact with the shaft portion 145, and allows the shaft portion 145 (the shaft member 143) to rotate around the center axis C. If the urging force F is too large, although it is possible to bring the bearing member 181 and the shaft portion 145 into contact with each other, the energy loss due to the rotation of the shaft portion 145 increases, resulting in deterioration in time indication accuracy. On the other hand, if the urging force F is too small, although the energy loss due to the rotation of the shaft portion 145 is small, the fluctuation in the shaft position when a strong impact is applied to the bearing 180 increases, resulting in deterioration in time indication accuracy. Thus, the elastic member 182 adopted is one having an appropriate urging force F.

According to this embodiment, the bearing 180 can impart an appropriate pressurization to the shaft portion 145 (the shaft member 143), so that it is possible to rotate the shaft portion 145 (the shaft member 143) around the center axis C, with no space formed between the shaft portion 145 and the bearing member 181. Thus, even if the attitude of the bearing 180 is changed or an impact is applied thereto, it is possible to suppress fluctuation in the position of the shaft member 143. As a result, it is possible to suppress fluctuation in the torque transmitted from the movement barrel 120 to the balance with hairspring 140, and to suppress fluctuation in the oscillation angle and the rate of the balance with hairspring 140, making it possible to achieve an improvement in terms of the time indication accuracy of a portable timepiece such as a wristwatch or a pocket watch.

Further, by constructing the bearing 180 as described above, it is possible to easily support and fix in position the elastic member 182 between the bearing member 181 and the frame member 166, making it possible to exert the urging force F between the bearing member 181 and the frame member 166 due to the spring portions 186. Further, since the frame member 166 is supported by and fixed to the balance bridge 167, the bearing member 181 strives to move in the urging direction with respect to the frame member 166. Thus, by urging the spring portion 186 toward the shaft portion 145 (the shaft member 143), it is possible to reliably urge the bearing member 181 in the direction of the shaft member, making it possible to bring the bearing member 181 and the shaft portion 145 into contact with each other. As a result, it is possible to suppress fluctuation in the position of the shaft member 143, thereby achieving an improvement in terms of the time indication accuracy of the timepiece.

Further, since the elastic member 182 is detachable with respect to the frame member 166, the elastic member 182 can be easily removed from the frame member 166 when performing maintenance on the bearing 180, making it possible to perform maintenance individually on each member. Thus, it is possible to achieve an improvement in terms of maintenance efficiency.

The present invention is not restricted to the above-described embodiment but covers various modifications of the above embodiment made without departing from the gist of the present invention. That is, the specific configuration, construction, etc. of the above embodiment are only given by way of example, and allow modifications as appropriate.

Figure 7:
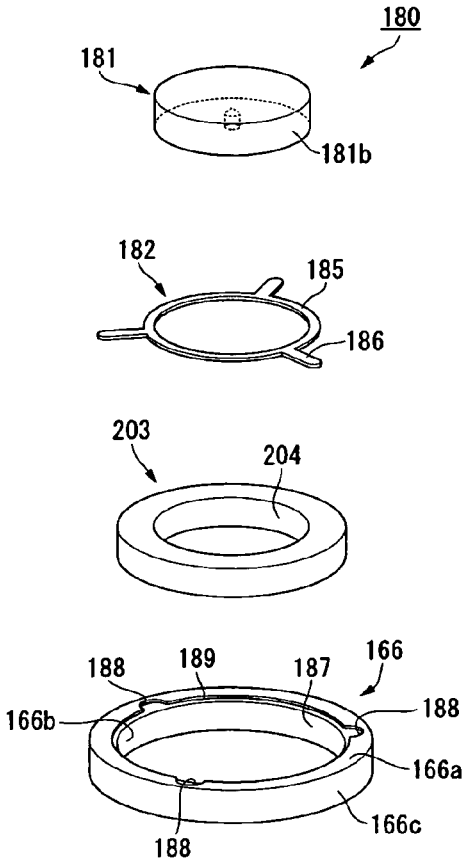
FIG. 7 is an exploded perspective view of another form (1) of a bearing according to an embodiment of the present invention.
Figure 8:
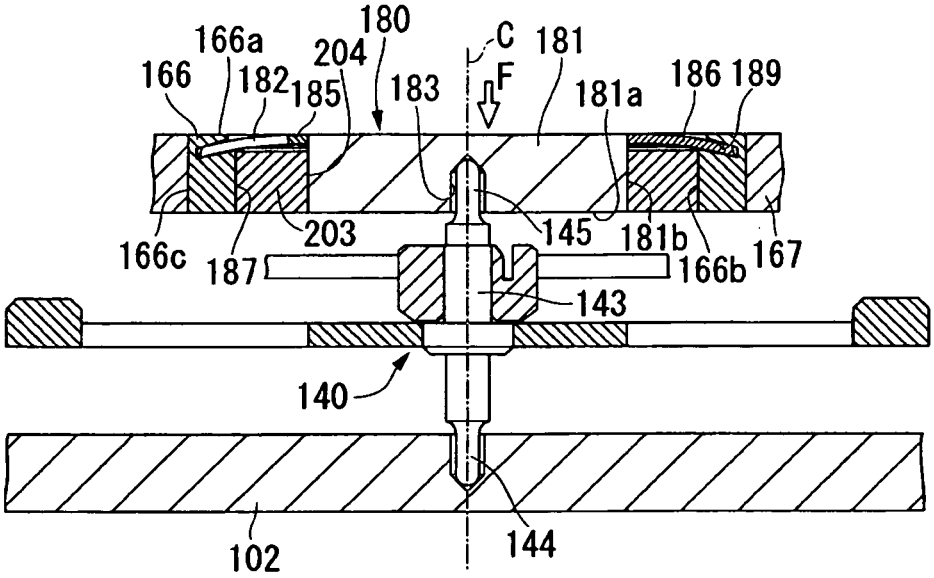
FIG. 8 is a sectional view of the other form (1) of a balance with hairspring and a bearing according to an embodiment of the present invention.

For example, as shown in FIGS. 7 and 8, it is also possible to arrange a substantially cylindrical guide member 203 in a space portion formed between the frame member 166 and the bearing member 181. The guide member 203 is formed in a size allowing it to be forced into and fixed to the inner peripheral surface 166*b* of the frame member 166, and is formed such that the bearing member 181 can be arranged inside a through-hole 204 of the guide member 203. Due to this construction, even if the bearing member 181 strives to move in the radial direction, the radial movement can be regulated by the guide member 203. In this connection, it is desirable for a slight gap to be formed between the inner peripheral surface of the guide member 203 and the outer peripheral surface of the bearing member 181. On the other hand, it is also possible for the inner peripheral surface of the guide member to be fixed to the outer peripheral surface of the bearing member 181 so as to form a gap between the outer peripheral surface of the guide member and the inner peripheral surface of the frame member 166, regulating the moving direction of the bearing member 181.

Figure 9:
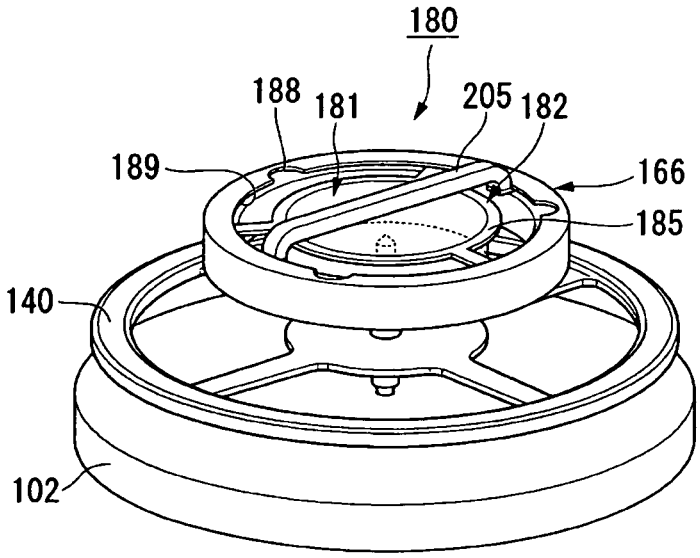
FIG. 9 is a perspective view of another form (2) of a balance with hairspring and a bearing according to an embodiment of the present invention.
Figure 10:
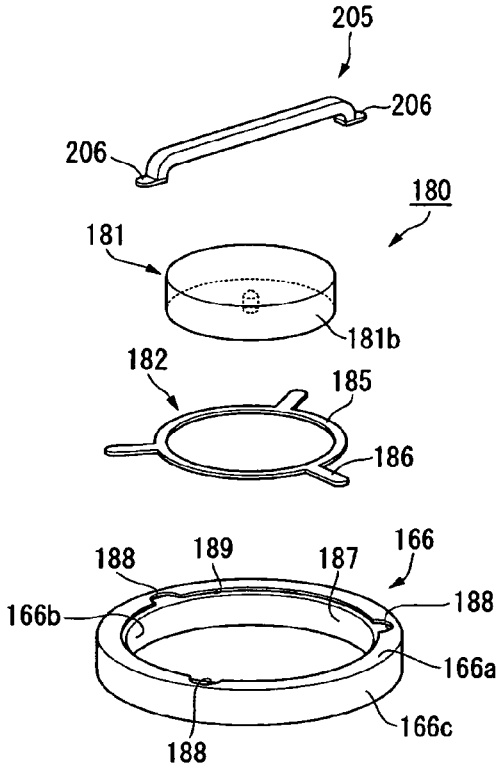
FIG. 10 is an exploded perspective view of the other form (2) of a bearing according to an embodiment of the present invention.
Figure 11:
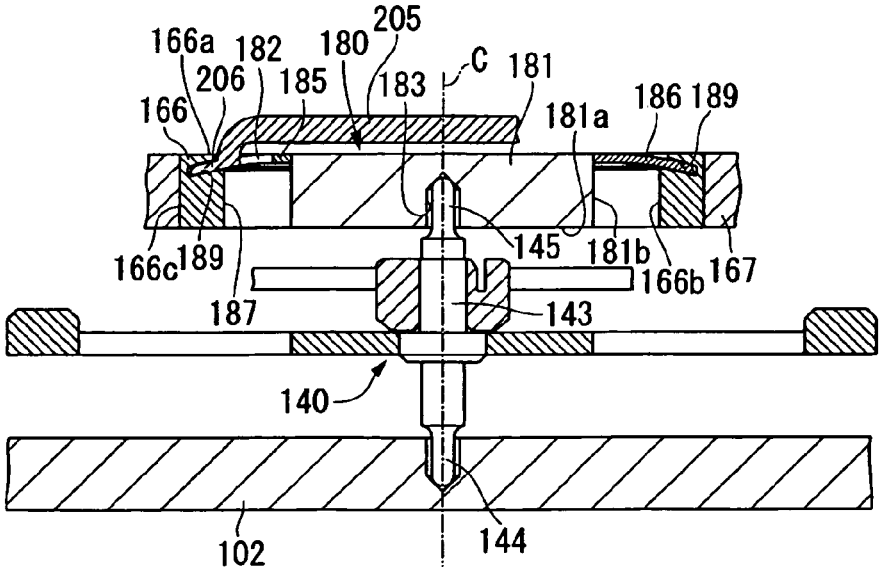
FIG. 11 is a sectional view of the other form (2) of a balance with hairspring and a bearing according to an embodiment of the present invention.

Further, as shown in FIGS. 9 through 11, it is also possible to provide, on the opposite side of the shaft portion 145 (the shaft member 143) via the bearing member 181, a stopper member 205 regulating the axial displacement amount of the bearing member 181. Due to the arrangement of the stopper member 205, when the attitude of the timepiece is changed or an impact is applied thereto, the bearing member 181 hits the stopper member 205, whereby it is possible to regulate its axial displacement. As a result, it is possible to suppress axial positional fluctuation of the shaft member 143, making it possible to improve the time indication accuracy of the timepiece. The stopper member 205 is fixed, for example, to the frame member 166 while forming an axial gap between itself and the bearing member 181. To fix the stopper member to the frame member 166, there are formed, for example, lock portions 206 at both ends of the stopper member 205, and the lock portions 206 are locked to the groove portion 189 of the frame member 166. Due to this construction, it is possible to arrange the stopper member 205 without affecting the urging force F for urging from the bearing member 181 toward the shaft member.

Figure 12:
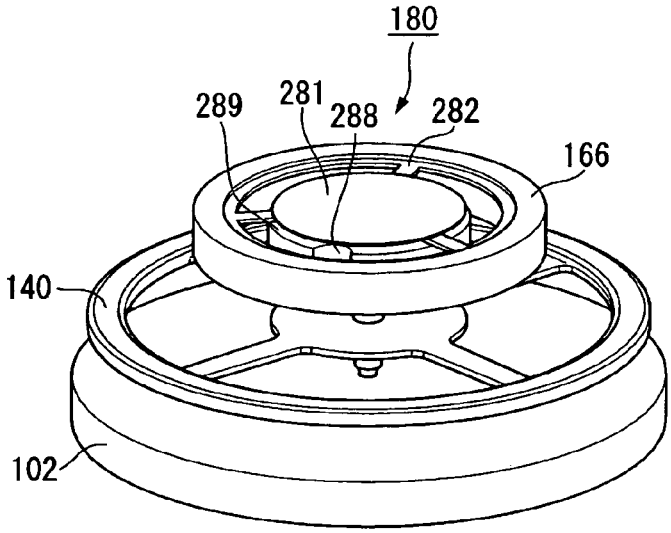
FIG. 12 is a perspective view of another form (3) of a balance with hairspring and a bearing according to an embodiment of the present invention.
Figure 13:
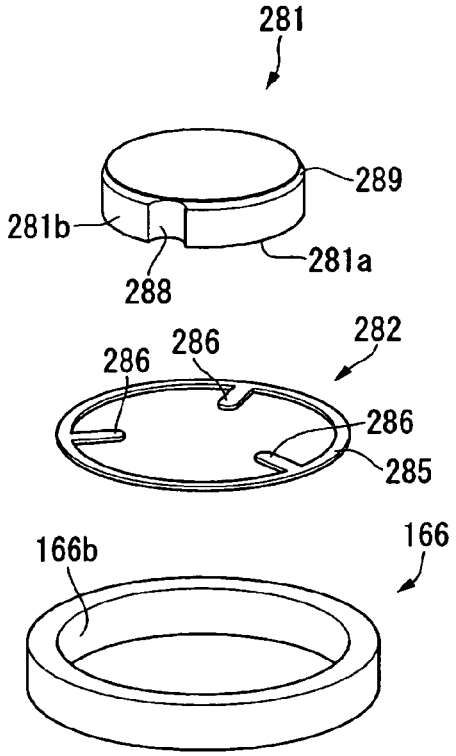
FIG. 13 is an exploded perspective view of the other form (3) of a bearing according to an embodiment of the present invention.
Figure 14:
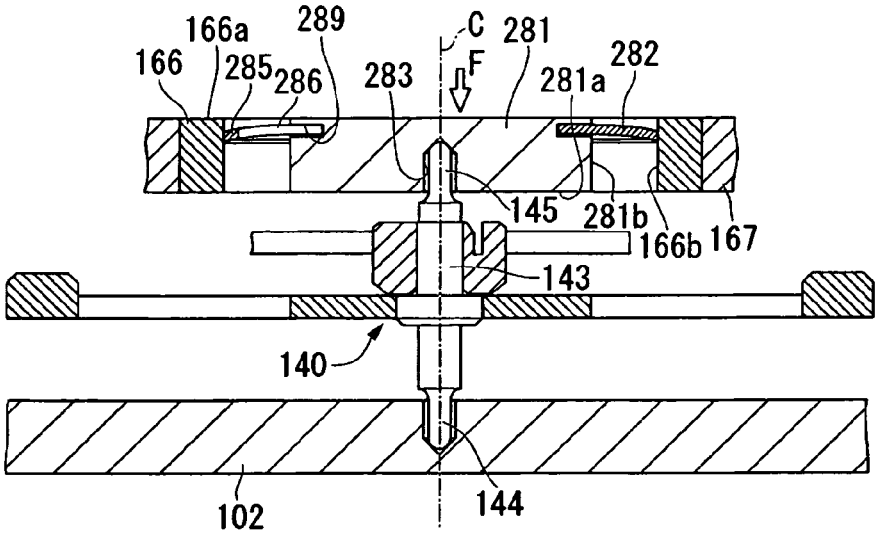
FIG. 14 is a sectional view of the other form (3) of a balance with hairspring and a bearing according to an embodiment of the present invention.

Further, as shown in FIGS. 12 through 14, it is also possible to adopt, as an elastic member 282, one equipped with an outer ring portion 285 forced into the inner peripheral surface 166*b* of the frame member 166 for fixation, and a plurality of spring portions 286 extending radially inwards from the outer ring portion 285. In this case, cutout portions 288 allowing insertion of the forward ends of the spring portions 286 of the elastic member 282 are formed in one surface 281*a* of a bearing member 281 in conformity with the configuration of the spring portions 286. Further, in the outer peripheral surface 281*b* of the bearing member 281, there is formed, over the entire periphery, a groove portion 289 supporting the forward ends of the spring portions 286 in the peripheral direction through fit-engagement. And, the cutout portions 288 and the groove portion 289 are connected with each other. That is, by mating the forward ends of the spring portions 286 with the positions of the cutout portions 288 and inserting them, it is possible to arrange the forward ends of the spring portions 286 in the groove portion 289, and, in this state, the elastic member 282 is rotated in the peripheral direction with respect to the bearing member 281 to support and fix the forward ends of the spring portions 286 in the groove portion 289, whereby it is possible to support and fix in position the elastic member 282 in the bearing member 281. Due to this construction, when performing maintenance on the bearing 280, the elastic member 282 can be easily removed from the bearing member 281, and it is possible to perform maintenance individually on each member. Thus, it is possible to achieve an improvement in terms of maintenance efficiency.

Further, while in the above embodiment the elastic member 182 is arranged between the frame member 166 and the bearing member 181 and urging is effected from the bearing member 181 toward the shaft portion 145 (the shaft member) with the appropriate urging force F, it is also possible to provide a pressurization adjustment mechanism capable of adjusting this urging force F. By providing the pressurization adjustment mechanism, even in the case of bearings and shaft members with individual difference, it is possible to adjust pressurization for each individual bearing and shaft member, making it possible to easily set the urging force F to a proper force capable of rotating the shaft member around the center axis C while always holding the bearing member 181 and the shaft portion 145 (the shaft member) in contact with each other. Thus, it is possible to adjust the energy loss and wear amount in the bearing to a substantially fixed level.

Figure 15:
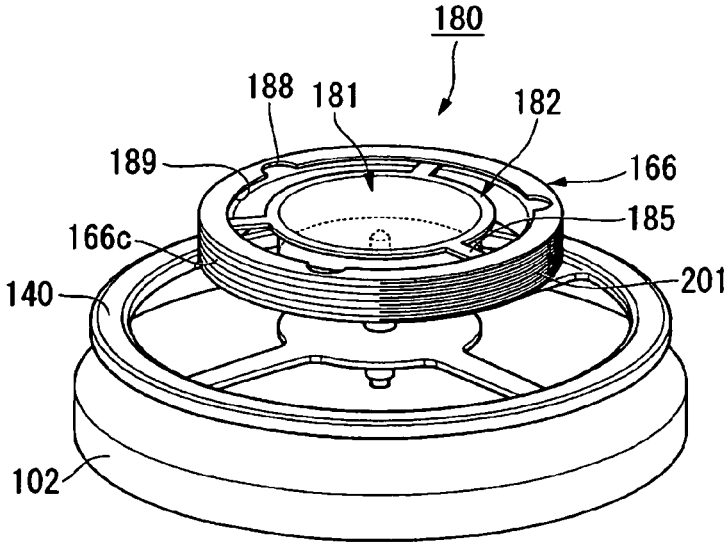
FIG. 15 is a perspective view of another form (4) of a balance with hairspring and a bearing according to an embodiment of the present invention.
Figure 16:
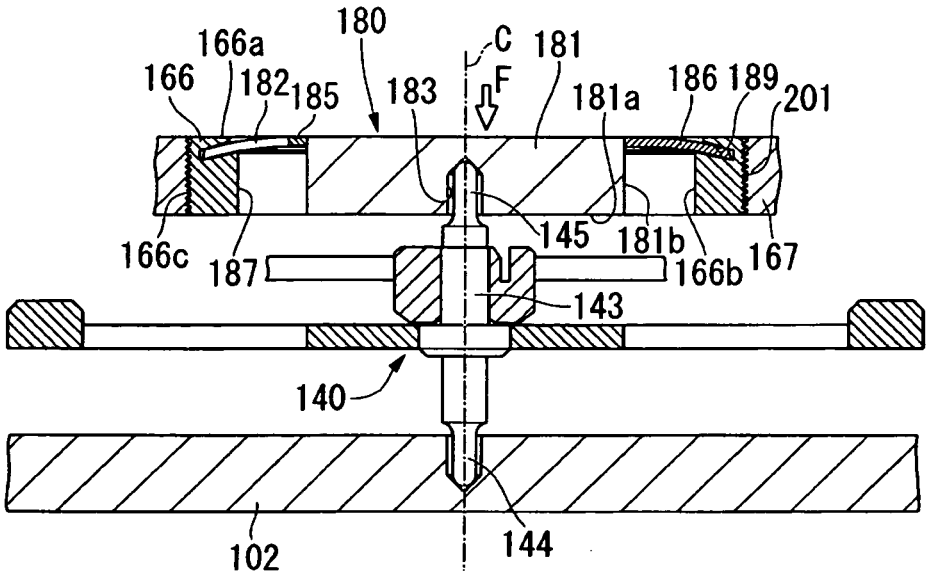
FIG. 16 is a sectional view of the other form (4) of a balance with hairspring and a bearing according to an embodiment of the present invention.

As an example of the pressurization adjustment mechanism, there is formed, as shown, for example, in FIGS. 15 and 16, a screw portion 201 between the outer peripheral surface 166*c* of the frame member 166 and the inner peripheral surface of the balance bridge 167. By thus forming the screw portion 201, the degree to which the frame member 166 is threadedly engaged with the balance bridge 167 is adjusted, whereby it is possible to easily adjust the urging force F with which urging is effected from the bearing member 181 toward the shaft portion 145 (the shaft member 143). Further, due to the above-described screw structure between the outer peripheral surface 166*c* of the frame member 166 and the inner peripheral surface of the balance bridge 167, the frame member 166, the elastic member 182, and the bearing member 181 are collectively detachable with respect to the balance bridge 167, so that it is possible to form the frame member 166, the elastic member 182, and the bearing member 181 integrally while maintaining the maintenance efficiency.

Figure 17:
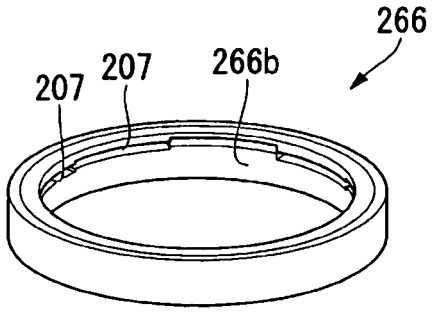
FIG. 17 is a perspective view of another form (5) of a frame member according to an embodiment of the present invention.
Figure 18:
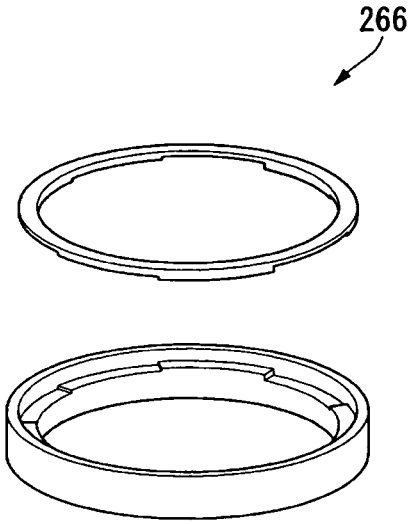
FIG. 18 is an exploded perspective view of the other form (5) of a frame member according to an embodiment of the present invention.

Further, as another example of the pressurization adjustment mechanism, it is also possible, as shown, for example, in FIGS. 17 and 18, a plurality of spring support recesses 207 in an inner peripheral surface 266*b* of a frame member 266 at axially deviated positions. Due to this construction, the positions at which the spring portions 186 of the elastic member 182 are supported are selected from a plurality of spring support recesses 207 formed at axially deviated positions, whereby it is possible to easily adjust the urging force F with which urging is effected from the bearing member 181 toward the shaft portion 145 (the shaft member 143). As shown in FIG. 18, when forming the spring support recesses 207, the frame member 266 is formed so as to be capable of being axially divided at the positions of the spring support recesses 207. That is, in the state in which the frame member 266 is divided, the forward ends of the spring portions 186 of the elastic member 182 are arranged in the spring support recesses 207 at desired positions, and, in this state, the frame member 266 is integrated, whereby the positions of the spring portions 186 can be easily adjusted, making it possible to easily adjust the urging force F of the spring portions 186.

Figure 19:
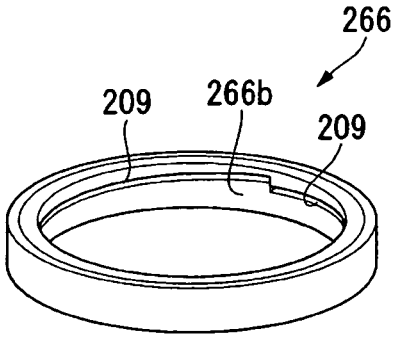
FIG. 19 is a perspective view of another form (6) of a frame member according to an embodiment of the present invention.

Further, as still another example of the pressurization adjustment mechanism, it is also possible, as shown, for example, in FIG. 19, to spirally form a spring support groove portion 209 in the inner peripheral surface **266*b* of the frame member 266. Due to this construction, through movement of the forward ends of the spring portions 186 of the elastic member 182 along the spring support groove portion 209, it is possible to easily adjust the urging force F with which urging is effected from the bearing member 181 toward the shaft portion 145 (the shaft member 143). That is, when forming the spring support groove portion 209, by rotating the elastic member 182 around the center axis C along the spring support groove portion 209, the positions of the forward ends of the spring portions 186 can be adjusted, that is, the urging force F of the spring portions 186** can be easily adjusted.

Further, while in the above embodiment the bearing member 181, the elastic member 182, the frame member 166, the guide member 203, and the stopper member 205 are formed as separate components, it is also possible to form a part of these components integrally. For example, it is also possible to form the bearing member 181 and the elastic member 182 integrally, or form the elastic member 182 and the frame member 166 integrally, or form the frame member 166 and the stopper member 205 integrally, or form the bearing member 181 and the stopper member 205 integrally, or form the bearing member 181 and the guide member 203 integrally, or form the frame member 166 and the guide member 203 integrally. In such a construction, it is possible to reduce the number of components, and achieve an improvement in terms of the production efficiency at the time of production and of the maintenance efficiency at the time of maintenance.

Further, it is also possible to adopt a construction in which the guide member 203, the stopper member 205, and the pressurization adjustment mechanism are combined with each other.

Figure 20:
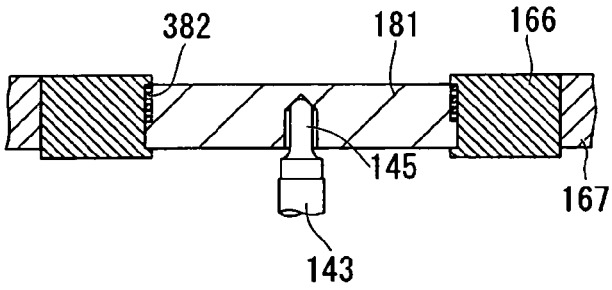
FIG. 20 is a sectional view of another form (7) of a balance with hairspring and a bearing according to an embodiment of the present invention.
Figure 21:
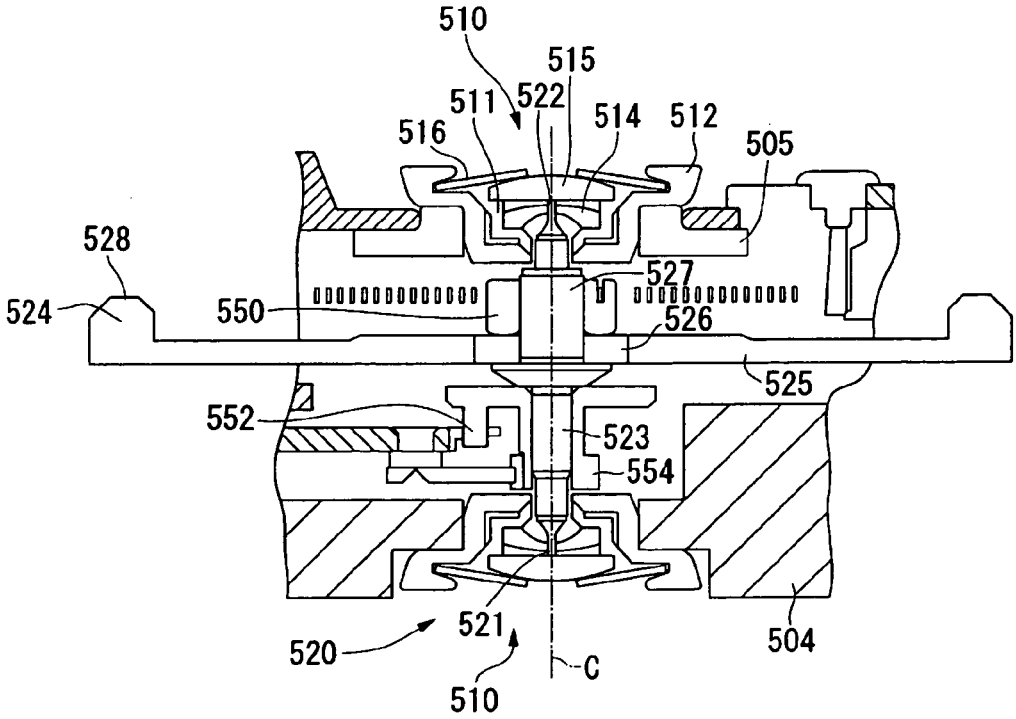
FIG.21 PRIOR ART
FIG. 21 is a schematic partial sectional view showing the construction of a conventional balance with hairspring.

Further, while the above embodiment adopts a plate spring member as the elastic member, it is also possible to adopt, as shown in FIG. 20, a construction in which a coil spring 382 is arranged between the bearing member 181 and the frame member 166.

Further, while in the above-described embodiment the bearing 180 is provided on the shaft portion 145 side, it is also possible to arrange the bearing 180 on the shaft portion 144 side.

Further, while the above-described embodiment adopts the bearing 180 constructed as described above as the bearing arranged in the balance with hairspring 140, it is also possible to adopt the bearing 180 as described above, apart from the balance with hairspring 140, as the bearing of the movement barrel 120, of the center wheel & pinion 124, of the third wheel & pinion 126, of the second wheel & pinion 128, of the escape wheel & pinion 130, and of the pallet fork 142. By thus providing the bearing 180 at each of these portions, it is possible to rotate a shaft member around an axis with no space formed between the shaft member and the bearing member. Thus, even if the attitude of the timepiece bearing is changed or an impact is applied thereto, it is possible to suppress fluctuation in the position of the shaft member. As a result, it is possible to suppress fluctuation in torque, so that it is possible to achieve an improvement in terms of the time indication accuracy of the timepiece. Further, since the construction easily allows division into the individual components, it is possible to easily perform maintenance on each component, making it possible to achieve an improvement in terms of maintenance efficiency.

What is claimed is:

1. A timepiece bearing comprising:

a bearing member of unitary structure that is provided at least at one end portion of a shaft member which is rotatable around an axis and that regulates movement of the shaft member in axial and radial directions of the shaft member;

an elastic member for applying an urging force in an axial direction of the bearing member to hold the bearing member in contact with the shaft member;

a frame member containing the bearing member; and a pressurization adjustment mechanism capable of adjusting an urging force from the bearing member toward the shaft member;

wherein the elastic member establishes connection between the bearing member and the frame member, and the frame member is supported by and fixed to a support member; and wherein the shaft member is rotatable around the axis while the shaft member and the bearing member are held in contact with each other by the elastic member.

2. The timepiece bearing according to claim 1, wherein the elastic member comprises:

an inner ring portion fixedly mounted to an outer peripheral surface of the bearing member; and a plurality of spring portions extending radially outwards from the inner ring portion;

wherein forward ends of the spring portions are formed so as to be capable of being supported by the frame member.

3. The timepiece bearing according to claim 1, wherein the elastic member comprises:

an outer ring portion fixedly mounted to an inner peripheral portion of the frame member; and a plurality of spring portions extending radially inwards from the outer ring portion;

wherein forward ends of the spring portions are formed so as to be capable of being supported by the bearing member.

4. The timepiece bearing according to claim 1, wherein the pressurization adjustment mechanism comprises a screw portion formed between an outer peripheral surface of the frame member and an inner peripheral surface of the support member.

5. The timepiece bearing according claim 1, wherein the pressurization adjustment mechanism comprises a plurality of spring support recesses formed in an inner peripheral surface of the frame member at axially deviated positions.

6. The timepiece bearing according claim 1, wherein the pressurization adjustment mechanism comprises a spirally formed spring support groove portion formed in an inner peripheral surface of the frame member.

7. The timepiece bearing according to claim 2, further comprising an attachment/detachment mechanism allowing attachment and detachment of the elastic member to and from the frame member.

8. The timepiece bearing according to claim 7, wherein the attachment/detachment mechanism comprises fit-engagement protrusions formed at the forward ends of the spring portions of the elastic member, and a fit-engagement recess formed in one axial end surface of the frame member; and wherein after the fit-engagement protrusions of the elastic member have passed the fit-engagement recess of the frame member, upon relative movement between the elastic member and the frame member, the elastic member is rotated along an engagement groove portion formed in a peripheral direction in an inner peripheral surface of the frame member, whereby the elastic member is attached to and supported by the frame member.

9. The timepiece bearing according to claim 3, further comprising an attachment/detachment mechanism allowing attachment and detachment of the elastic member to and from the bearing member.

10. The timepiece bearing according to claim 9, wherein the attachment/detachment mechanism comprises fit-engagement protrusions formed at the forward ends of the spring portions of the elastic member, and a fit-engagement recess formed in one axial end surface of the bearing member; and wherein after the fit-engagement protrusions of the elastic member have passed the fit-engagement recess of the bearing member upon relative movement between the elastic member and the frame member, the elastic member is rotated along an engagement groove portion formed in a peripheral direction in an outer peripheral surface of the bearing member, whereby the elastic member attached to and is supported by the bearing member.

11. The timepiece bearing according to claim 1, further comprising a stopper member for regulating an axial displacement amount of the bearing member, the stopper member being provided on an opposite side of the shaft member through the intermediation of the bearing member.

12. The timepiece bearing according to claim 11, wherein the stopper member is fixedly mounted to the frame member and is arranged with an axial gap between itself and the bearing member.

13. The timepiece bearing according to claim 1, further comprising a guide member for restricting movement of the bearing member in the axial direction.

14. The timepiece bearing according to claim 13, wherein the guide member is fixed to an inner peripheral surface of the frame member.

15. The timepiece bearing according to claim 1, wherein the bearing member and the elastic member are formed integrally with one another.

16. The timepiece bearing according to claim 1, wherein the elastic member and the frame member are formed integrally with one another.

17. The timepiece bearing according to claim 11, wherein the frame member and the stopper member are formed integrally with one another.

18. The timepiece bearing according to claim 13, wherein the frame member and the guide member are formed integrally with one another.

19. A timepiece movement comprising: a barrel drum, wheels & pinions, an escape wheel & pinion, a pallet fork, and a balance with hairspring; wherein a timepiece bearing as claimed in claim 1 is used at least as a bearing of the balance with hairspring.

20. A portable timepiece comprising: a movement as claimed in claim 19; and a casing containing the movement.

21. A timepiece bearing according to claim 1, wherein the bearing member has an insertion hole formed as a blind bore into which the end portion of the shaft member is inserted.

22. A timepiece bearing according to claim 21, wherein a bottom portion of the insertion hole is formed with a tapered portion; and wherein the end portion of the shaft member is inserted into the insertion hole of the bearing member so that a forward end of the end portion of the shaft member is in line contact with the tapered portion of the insertion hole.

23. A timepiece bearing comprising:

a frame member;

a bearing member mounted in the frame member for regulating movement of a rotational shaft member in axial and radial directions of the rotational shaft member;

an elastic member for applying a pressure force in an axial direction of the bearing member to establish a connection between the bearing member and the frame member and to maintain pressure contact between the rotational shaft and the bearing member while the rotational shaft member undergoes rotation; and a pressurization adjustment mechanism configured for adjusting a pressure force applied in the axial direction of the bearing member.

24. A timepiece bearing according to claim 23, wherein the bearing member is of unitary construction.

25. A timepiece bearing according to claim 23, wherein the bearing member has a blind bore configured to receive an end portion of the rotational shaft member.

* * * * *